US007507925B2

(12) United States Patent
Rudolf et al.

(10) Patent No.: US 7,507,925 B2
(45) Date of Patent: Mar. 24, 2009

(54) POWER TOOL

(75) Inventors: Boris Rudolf, Stuttgart (DE); Sigmund Braun, Kusterdingen (DE); Christof Kress, Deizisau (DE)

(73) Assignee: C. & E. Fein GmbH (DE)

( * ) Notice: Subject to any disclaimer, the term of this patent is extended or adjusted under 35 U.S.C. 154(b) by 590 days.

(21) Appl. No.: 11/202,580

(22) Filed: Aug. 12, 2005

(65) Prior Publication Data

US 2006/0032650 A1 Feb. 16, 2006

Related U.S. Application Data

(63) Continuation of application No. PCT/EP03/14277, filed on Dec. 16, 2003.

(30) Foreign Application Priority Data

Feb. 13, 2003 (DE) ..... 103 06 682

(51) Int. Cl.
*H01H 9/00* (2006.01)

(52) U.S. Cl. ..... 200/332.2; 200/511; 200/302.2; 200/43.17

(58) Field of Classification Search ..... 200/43.17, 200/61.85, 522, 332, 332.1, 332.2, 511, 302.1, 200/302.2, 302.3; 318/446, 453; 173/170
See application file for complete search history.

(56) References Cited

U.S. PATENT DOCUMENTS

| | | | | |
|---|---|---|---|---|
| 3,651,391 | A * | 3/1972 | Vogelsberg | 318/446 |
| 5,563,482 | A * | 10/1996 | Shaw et al. | 318/272 |
| 5,675,228 | A | 10/1997 | O'Bryan | 318/453 |
| 5,725,086 | A * | 3/1998 | Cooper | 200/302.3 |
| 5,990,431 | A * | 11/1999 | Wright | 200/302.3 |
| 6,331,686 | B1 * | 12/2001 | Rogatschnig | 200/302.2 |
| 6,527,630 | B2 * | 3/2003 | Mannsperger et al. | 451/344 |
| 6,528,749 | B2 * | 3/2003 | Hori et al. | 200/293 |
| 6,608,270 | B2 * | 8/2003 | Donofrio et al. | 200/302.1 |
| 6,790,134 | B2 * | 9/2004 | Swaddle et al. | 451/355 |
| 6,860,792 | B2 * | 3/2005 | Krondorfer et al. | 451/8 |
| 7,053,325 | B2 * | 5/2006 | Yuasa et al. | 200/522 |
| 7,322,506 | B2 * | 1/2008 | Forster | 227/133 |

FOREIGN PATENT DOCUMENTS

| | | |
|---|---|---|
| DE | 40 16 122 A1 | 11/1990 |
| DE | 40 27 135 A1 | 3/1992 |
| DE | 43 36 620 C2 | 5/1995 |
| DE | 44 38 045 C2 | 5/1996 |
| DE | 197 15 536 A1 | 10/1998 |
| DE | 199 32 578 A1 | 6/2000 |
| EP | 0 628 762 A1 | 12/1994 |
| GB | 2 234 115 | 1/1991 |

OTHER PUBLICATIONS

PCT International Search Report (3 pages, Apr. 22, 2004).

* cited by examiner

*Primary Examiner*—Michael A Friedhofer
(74) *Attorney, Agent, or Firm*—St. Onge Steward Johnston & Reens LLC

(57) ABSTRACT

A power tool is disclosed which comprises a hosing within which a motor is received for driving a tool. At least one switch is received on said housing and can be operated via an elastic touch surface from outside the housing. The switch is part of a signaling circuit which is coupled to a power circuit for activating the motor when said signaling circuit is activated.

20 Claims, 2 Drawing Sheets

POWER TOOL

This is a continuation application of International Patent Application PCT/EP03/14277 filed on Dec. 16, 2003 claiming priority of German patent application serial number 10306682.9 filed on Feb. 13, 2003 which is fully incorporated by reference herewith.

BACKGROUND OF THE INVENTION

The present invention relates to a power tool having a motor, for driving a power tool, and at least one switching element.

Power tools require diverse switches for switching the motor on and off, and if necessary for performing additional control functions. Usually, one uses for this purpose switches offering an adequate load capability that are sized for the respective rated operational voltage and are capable of switching the sometimes rather high load currents in a range of up to 10 amperes or over. It is understood that switches must be sufficiently robust to ensure that they will not fail, even in professional use where long service times and numerous switching operations are encountered.

As a rule, one therefore uses a single on/off switch only, or at least two on/off switches for controlling the actuation of the motor. In connection with powerful angle sanders, designed as so-called "two-hand" angle sanders, is has been usual, for example, to configure the rear end of the housing as a handle provided with an on/off switch that can be actuated via a pushbutton. In operation, the angle sander is then held by one hand gripping a butt provided on the side of the housing and the other hand gripping the rear handle, while simultaneously actuating the handle pushbutton. When the rear handle is released, the power supply to the motor is interrupted and braking of the angle sander is initiated, if desired.

With a view to improving the ergonomics of the design, it would on principle be desirable to have the possibility to provide switches at any position within the power tool, if possible, and to permit such switches to be actuated very easily and in a force-saving way. Such flexibility does not exist, however, in conventional power tools as due to the requirement that the switches be adequately sizes, the switches have a considerable overall size and can be integrated in the housing at specific points only. In addition, a number of safety rules have to be observed in this connection with the effect that guiding the supply line to a mains switch through a motor housing, for example, is possible only if certain special protective measures are observed, which considerably increases the costs of such an arrangement or even makes its realization impossible.

SUMMARY OF THE INVENTION

It is a first object of the present invention to provide an improved power tool having at least one switching element that provides improved ergonomics. At the same time, actuation of the switching element should be as simple as possible.

This object is achieved, according to a first embodiment of the invention, by a power tool having a motor for driving a tool and at least one switching element, which is connected in a signal circuit and is coupled to a load circuit via at least one power switching element, the arrangement being such that the switching element can be actuated via an elastic touch area incorporated in a housing.

By having the switching element connected merely to a signal circuit, the invention provides the possibility to size the switching element for a signaling function only. This leads to a considerably reduced overall size of the switching element. As a result, the switching element can be actuated via an elastic touch area which is integrated in a housing of the power tool.

The invention thereby achieves clearly improved ergonomics as due to the reduced overall size and easy actuation at numerous points of the power tool the switching element can be located at an especially favorable position and can be actuated easily via the elastic touch area. Given the fact that the switching element is connected to a signal circuit only and may further be separated from the power circuit galvanically, if desired, any protective measures that may be required in order to guarantee protection from electric shock hazards are considerably simplified.

According to an alternative embodiment of the invention, the object is achieved by a power tool having a motor for driving a tool and at least two switching elements, each connected in a signal circuit and coupled to a load circuit via at least one power switching element, through which the motor can be controlled.

This likewise guarantees considerably improved ergonomics of the power tool. Moreover, it is possible in this way to achieve a slimmer design, for example.

This is so because it is possible in this way to integrate a plurality of switching elements, which are connected to a signal circuit only, at different points in a housing of the power tool or, for example, in a handle. Given the fact that the switching elements are operated only in a signal circuit and, thus, merely perform a signaling function, the resulting reduced size provides clearly improved flexibility as regards their integration in a housing or in a handle, for example. Given the fact that the switching elements perform a signaling function only, and are therefore not connected to mains voltage, the switching elements can be operated also at low voltage, if desired in a manner galvanically decoupled from the circuit. As has been mentioned before, this clearly simplifies the protective measures for providing the necessary protection from electric shock hazards.

Advantageously, there is also the possibility to actuate a plurality of switching elements, being connected in signal circuits and coupled to a load circuit via at least one power switching element, via elastic touch areas in the housing of the power tool.

As has been mentioned before, additional advantages are achieved when the power switching element guarantees galvanic separation of the load circuit from the signal circuit or the signal circuits.

The power switching element may take the form of a relay or a power semiconductor, for example. In order to ensure low-wear switching and, at the same time, galvanic separation between the power circuit and the signal circuit, a configuration as optocoupler with power semiconductor devices is especially advantageous.

The switching elements used preferably have the smallest possible overall size and, advantageously, are designed as micro switches. The term micro switch means in this connection a switching element whose contact gap between the different switching states is $\leqq 3$ mm.

As a result of the small overall size, such a micro gap construction permits a plurality of switching elements to be located at different points of the power tools with a view to guaranteeing especially ergonomic handling of the tool. It is possible in this way, for example, to provide two, three or even more switching elements at different points in the handle area of the power tool, which switching elements preferably can be actuated from the outside, via elastic touch areas, as the power tool is being gripped.

According to an advantageous further development of the invention, one or more of the switching elements may be designed as pushbuttons, for example.

With the aid of such a design it is possible to implement a power tool which, for being permanently actuated, requires that the handle be fully gripped and which when the handle is released, immediately interrupts the power supply and, if necessary, initiates a braking operation. Such a design is of advantage especially for power tools with a relatively high risk potential, such as hand-held disk saws or the like. Further, a plurality of switching elements may be provided through which the motor can be switched on when at least one of the switching elements is closed.

This provides the possibility to arrange switching elements at different points of the power tool, which allow the motor to be switched on if at least one of them is actuated.

According to an alternative embodiment of the invention, a plurality of switching elements can be coupled to a circuit through which the motor can be switched on when at least two switching elements are closed.

This improves the operating safety because it can be ensured that the motor can be switched on only when the handle or a housing is gripped at a defined point that permits actuation of the different switching elements. Moreover, it can be provided that switching-on the power tool is possible only when the power tool is gripped by two hands at different points.

According to another embodiment of the invention, the power tool comprises at least one actuation member or attachment part which is associated to a switching element for status or position checking.

This opens up numerous possibilities for checks for an actuation member or an attachment part. For example, it can be guaranteed that switching-on of the motor is possible only when an actuating element, for example a clamping lever, occupies a predefined position. Further, it can be ensured that starting of the motor will be possible only if a given attachment occupies a predefined installed position on the power tool.

According to a further embodiment of the invention, if the power tool is configured as an angle sander or a hand-held disk saw, for example, the attachment part may be configured as protective cover and the switching element may permit activation of the motor only after correct mounting of the protective cover.

Further, it can be ensured in this case, for example in connection with exchangeable protective covers for angle sanders, that starting of the motor will be possible only if the particular protective cover of a given type, provided for the respective angle sander, has been mounted.

According to a further embodiment of the invention, the attachment member is configured as a handle with an associated switching element that allows activation of the motor only if the switching element is actuated via the handle.

This permits the operating safety to be improved, especially for two-hand angle sanders.

According to a further embodiment of the invention, the power tool comprises a clamping lever for clamping the tool, which lever can be moved between a clamping position and a released position, there being further provided an associated switching element for checking the clamping position of the clamping lever.

Such an embodiment is of advantage especially for angle sanders provided with a clamping lever for clamping the tool without the tool being involved. It is then possible, with simple means, to guarantee that the angle sander can be put into operation only when the clamping lever is in its clamping position and, accordingly, the tool is safely clamped.

According to a further embodiment of the invention, there is provided a molded body, held on the housing of the power tool, on which is provided at least one support for a switching element. The body may consist, for example, of a three-dimensionally molded plastic element.

This permits assembly to be simplified, especially in cases where a plurality of switching elements is to be integrated in the power tool.

The molded body may be provided for this purpose with one or more electric lines adapted for being connected to the switching element or the switching elements. Further, suitable mounting supports for one or more switching elements may be provided on the molded body.

Further, the molded body, in combination with the housing, may shield at least one switching element mounted on the molded body, or electric lines, from contamination by dust, humidity or the like.

In this way, the molded body can be used especially for shielding the employed switching element from dust or the like. This contributes towards improving the operating safety.

According to a convenient further development of the invention, the molded body may consist of a vibration-damping and/or acoustically damping material.

The molded body may further be provided with means for electrically screening at least one electric line.

The entire wiring between the switching elements and the associated circuit via which the load circuit is coupled may be received on the molded body and may be configured, for example, as three-dimensionally shaped circuit board. Screening may be achieved, if necessary, through a full-surface copper layer applied on one side.

It is understood that the features of the invention mentioned above and those yet to be explained below can be used not only in the respective combinations indicated, but also in other combinations or in isolation, without leaving the scope of the present invention.

The switching elements according to the invention, being connected in signal circuits and serving to control load circuits, can be used with advantage for portable power tools. In fact, while such applications have been known in connection with stationary machine tools, the invention is not suggested by them because the requirements for stationary machines are absolutely different from those applicable to power tools.

BRIEF DESCRIPTION OF THE DRAWINGS

Further features and advantages of the invention will become apparent from certain preferred embodiments of the invention which will be described hereafter with reference to the drawings in which.

DETAILED DESCRIPTION OF THE DRAWINGS

Figure 1:
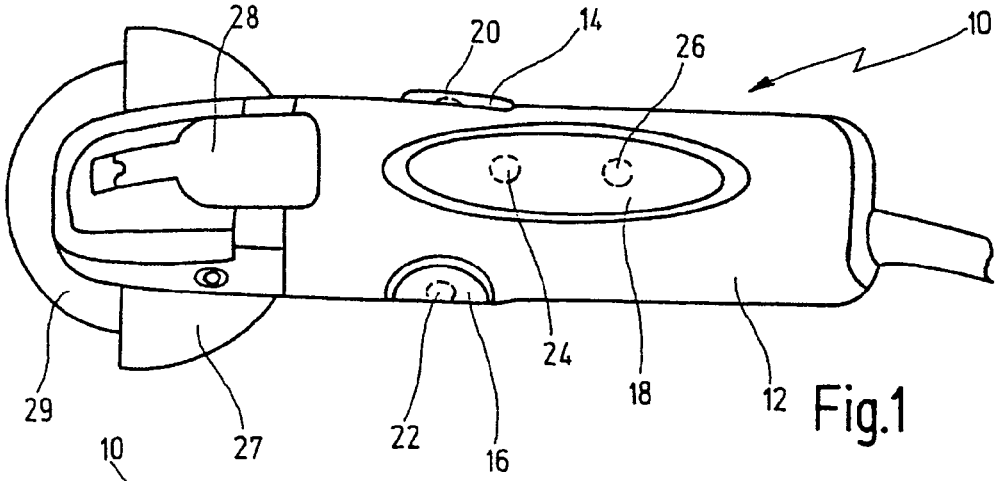
FIG. 1 shows a simplified perspective view of a first embodiment of a power tool according to the invention, in the form of an angle sander.

FIG. 1 shows a power tool according to the invention in the form of a one-hand angle sander, indicated generally by reference numeral 10.

The power tool 10 comprises an elongated housing 12 with a protective cover 27 supported on its front end. A clamping lever 28 serves for clamping a tool 29 in the form of a grinding wheel.

A total of three elastic touch areas are formed on the housing 12, namely an elongated oval touch area 18 on the top surface and two lateral smaller touch areas 14, 16 provided on the left and the right side walls of the housing 12. The touch areas 14, 16, 18 consist of an easily deformable material, such as silicon, and are integrated in the housing 12 whereby dust-tightness is guaranteed. Below the touch areas, associated switching elements 20, 22 or 24, 26, respectively, are provided in the area of the small touch areas 14, 16 or in the zone of the elongated touch area 18, respectively.

Now, the arrangement of the switching elements 20 to 26 and the touch areas 14 to 18 is such that the housing can be easily gripped by one hand while at the same time at least one of the switching elements 24, 26 in the area of the larger touch areas 18 on the top, and one switching element 20 or 22 in the area of the lateral touch areas 14 or 16, can be actuated when gripping the tool by the left or the right hand, respectively.

The switching elements being designed as micro switches, as will be described in more detail hereafter, it is possible in this way to achieve an especially ergonomic design and easy force-saving actuation of the switching elements. The arrangement may be selected to ensure that the motor of the power tool 10 can be actuated only if, with the housing 10 being gripped by the right hand, one of the switching elements 24, 26 in the area of the large touch areas 18 and the switching element 22 in the area of the left touch area 16 are actuated. At the same time, activation of the motor is rendered possible if one of the switching elements 24, 26 and the switching element 20 in the area of the right touch area 14 is actuated with the machine being gripped by the right hand.

Figure 2:
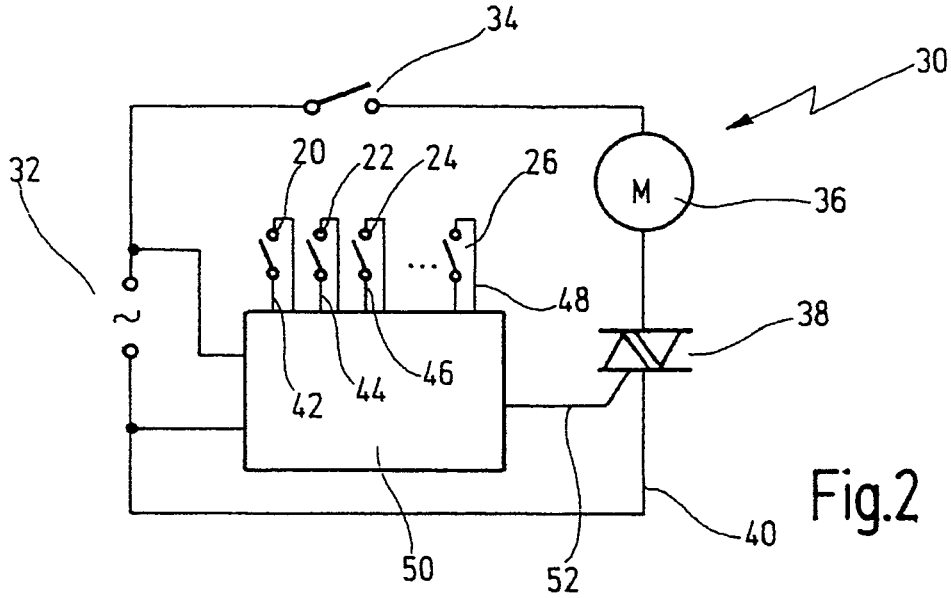
FIG. 2 shows a strongly simplified circuit diagram of a power tool according to the invention showing the switching element used, with signal circuits and the power switching element in the load circuit.

In FIG. 2, a block diagram of such a power tool is indicated generally be reference numeral 30.

A load circuit 40 comprises a motor 36, which is supplied with voltage from a voltage source 32 via a load switching element 38, for example in the form of a thyristor. The load circuit 40 may additionally comprise an on/off switch 34 for starting the unit.

Further, there is provided a series of switching elements 20, 22, 24, 26, each coupled to a common evaluation circuit 50 via a signal circuit 42, 44, 46, 48. The evaluation circuit 50 drives the power switching element 38 via a control line 52. The evaluation circuit 50 permits the power switching element 38 to be driven in response to certain switching conditions of the switching elements 22 to 26. Depending on the desired output characteristic, different output signals can be obtained in response to different input signal combinations at the signal circuits 42 to 48.

For example, switching-on of the power switching element 38 can be achieved when at least one of the switching elements 20 to 26 is switched on. Likewise, switching-on of the power switching element 38 can also be achieved when at least two or three of the different switching elements 20 to 26 are switched on. Further, a defined switching-on sequence of several switching elements may be required for switching on the power switching element 38. The selected strategies may be adapted in each case to the requirements of the particular power tool.

Since the switching elements 20 to 26 in the signal circuits 42 60 48 need not be sized to permit switching of the load current, but are only intended to perform a signaling function in the signal circuits 42 to 48, the switching elements can be correspondingly small and may be designed as micro switches. Accordingly, switching elements with contact gaps of □ 3 mm may be used. In contrast, the power switching element 38 is sufficiently sized to switch the currents in the load circuit 40.

It is understood that-the load switching element 38 may be of any type, provided the necessary requirements with respect to safe interruption of operation are met and the required operation is guaranteed even after numerous switching operations at high load. In addition to suitable power semiconductors, such as thyristors, transistors, or the like, relays basically may also be used for that purpose.

In addition, it is of course also possible to ensure galvanic separation between the signal circuits 42 to 48 and the load circuit 40, for example if the load switching element 38 is designed as a relay. An especially low-loss and reliable circuit with galvanic separation is obtained when the power switching element 38 is designed as power semiconductor and is driven via an optocoupler.

When using switching elements that need to switch a signal voltage only, instead of the full load current, the switching elements, due to their clearly smaller overall size and, if desired, galvanic disconnection from operating voltage, can be arranged at practically any desired point of the power tool 10. And it is also possible to provide several such switching elements at different points, for example to permit switching on and off of the motor or else for performing special signaling or checking functions.

Figure 3:
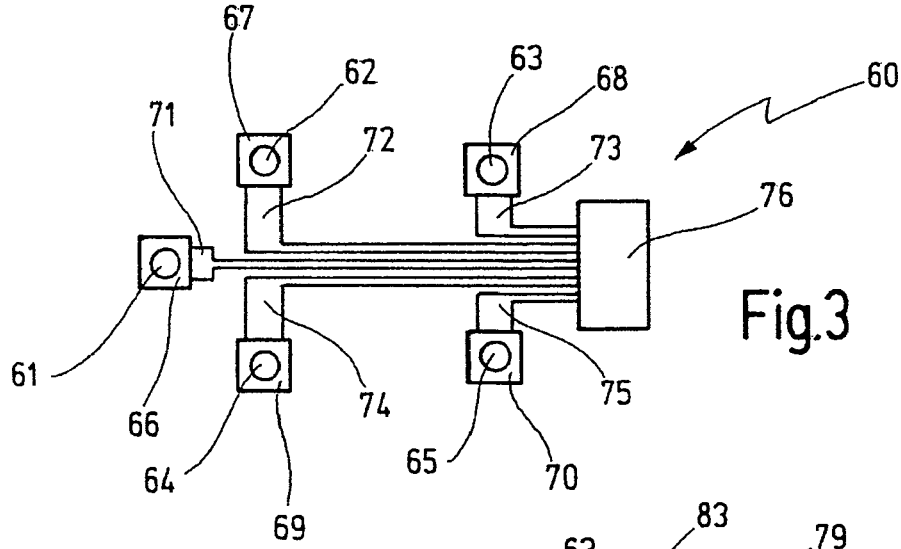
FIG. 3 shows a block diagram of a circuit comprising a total of five switching elements that can be actuated via elastic touch areas and which are coupled to a load circuit via a common evaluation circuit.

FIG. 3 shows a circuit 60 with a total of 5 switching elements 61, 62, 63, 64, 65. The switching elements 61 to 65 can be actuated via elastic touch areas 66, 67, 68, 69, 70 and are connected with a suitable evaluation circuit 76 via signal circuits 71, 72, 73, 74, 75. The power switching element 38 is then again driven via the evaluation circuit 76. It is understood that, depending on the particular application, a plurality of power switching elements may be provided. In addition, the connection lines between the switching elements 61 to 65 and the respective connection elements, such as the evaluation circuit 76, may be configured as a flexible printed circuit board.

Figure 4:
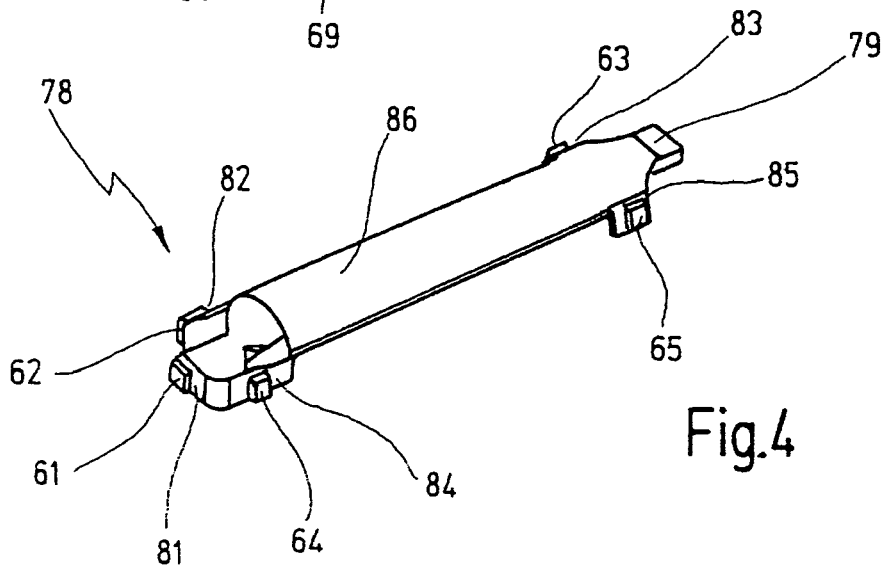
FIG. 4 shows a perspective view of a three-dimensionally shaped molded body on which supports for different switching elements are provided and in which the electric connection lines are integrated.

FIG. 4 shows a three-dimensionally shaped molded body indicated generally by reference numeral 78. The molded body 78 is provided at predetermined points with supports 81, 82, 83, 84, 85 intended to receive one switching element 62, 62, 63, 64, 65 each. In addition, the molded body 78 may be provided with integrated electric lines connecting the switching elements 61 to 65 with a common connection plug, for example. Further, a screening 86 may be integrated in the molded body 78, which may be designed as a unilateral full-surface copper foil, for example.

The molded body 78 may consist of a vibration-damping and/or acoustically damping material and may be designed, for example, as an injection-molded plastic part. Electric lines and, if desired, a screening may be provided on the top surface in the form of electric printed conductors, applied by usual electroplating methods.

The molded body may simultaneously be adapted to the housing of the power tool so as to guarantee protection of the respective switching elements and lines, if any, from contamination by dust, humidity or the like.

Figure 5:
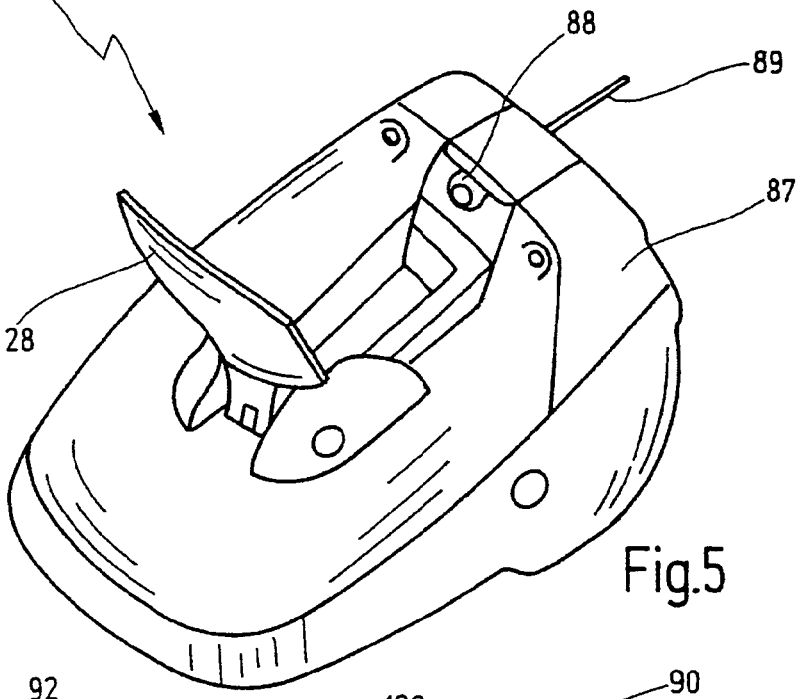
FIG. 5 shows an enlarged view of the area of the operating head of the power tool according to FIG. 1, with an associated switching element for checking the position of a clamping lever.

FIG. 5 shows a further use of a switching element 88 according to the invention in the area of an operating head 87 at the front end of the powertool 10.

A power tool 10 in the form of an angle sander comprises a clamping lever 28 for clamping the tool 29 without involvement of the tool. The clamping lever 28 can be moved between a clamping position and a released position, which latter is illustrated in FIG. 5. It being the intention that, for reasons of operating safety, the tool should be started only with the clamping lever 28 in closed condition, there has been provided the switching element 88 which is closed when the clamping lever 28 is moved to the closed position. A signal is then supplied to a connected evaluation circuit for further processing via the connected line 89.

Figure 6:
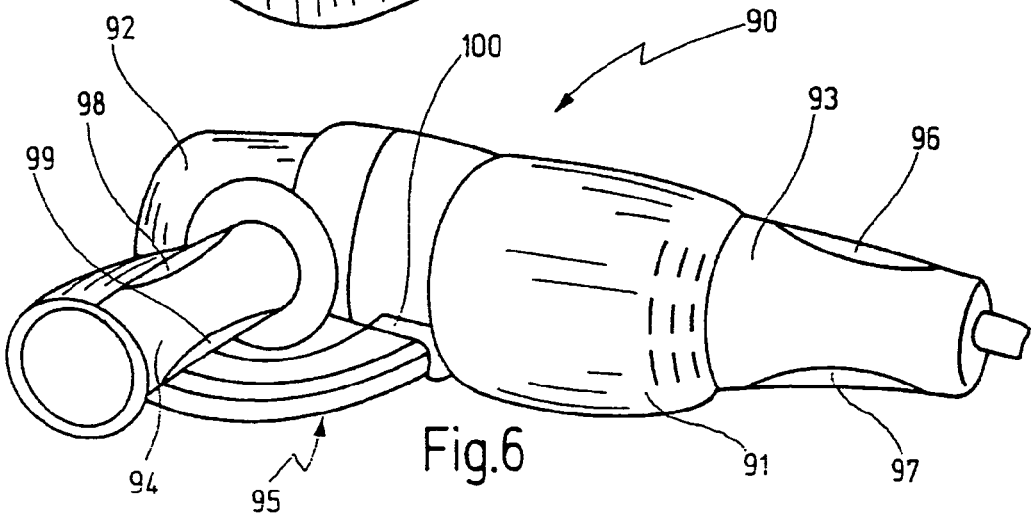
FIG. 6 shows a perspective view of a power tool in the form of a two-hand angle sander with switching elements in the area of a rear handle at the end of a housing, in the area of a butt and on the housing for checking the presence of an associated protective cover.

FIG. 6 finally shows a further embodiment of a power tool according to the invention, indicated generally by reference numeral 90.

The tool shown is a so-called two-hand angle sander. It comprises a housing 91 with a first handle 93 on the rear end of the housing, and a second handle 94 in the form of a butt arranged either on the left side of the housing 91 in the area of the operating head 92 or on the opposite right side.

In operation, the angle sander is held by two hands, namely by its rear handle 93 and by its butt 94. Both handles 93, 94 are provided with associated touch areas 96, 97 and 98, 99, respectively, through which micro switches—not shown—can be actuated as the handles are being gripped. Starting of the motor is possible only when at least one switching element in the area of the handle 94 and one switching element in the area of the handle 93 are actuated.

Moreover, the power tool 90 comprises a protective cover 95 mounted detachably on the housing 91. For checking whether a protective cover of the correct type has been mounted in the correct position, there is provided a further switching element 100 which is closed when the protective cover 95 has been mounted correctly. Starting of the angle sander is possible only with the protective cover 95 correctly mounted.

It is understood that the switching elements according to the invention, being connected in signal circuits, can be used in numerous variants and embodiments and at various points of a power tool for performing the most different switching and checking functions.

What is claimed is:

1. A power tool comprising:

a housing comprising a gripping region;

a motor received within said housing for driving a tool;

at least two switching elements configured as micro switches, said switching elements being connected in a signal circuit and being coupled to a load circuit via at least one power switching element;

at least two elastic touch areas integrated within said housing and being accessible from outside the housing for activating said switching elements;

at least one element selected from the group formed by an actuation member and an attachment part, said element coacting with at least one switching element for signaling a particular condition of said element;

wherein at least two of said elastic touch areas are arranged within said gripping region of said housing so that said elastic touch areas can be activated when gripping with one hand around said gripping region of said housing.

2. The power tool of claim 1, comprising at least two switching elements each of said switching elements being connected in a signal circuit and being coupled to a load circuit via at least one power switching element, which is configured for controlling the motor.

3. A power tool comprising:

a housing comprising a gripping region;

a motor received within said housing for driving a tool;

at least two switching elements configured as a micro switches, said switching elements being connected in a signal circuit and being coupled to a load circuit via at least one power switching element;

elastic touch areas being integrated within said gripping region of said housing and being accessible from outside the housing for activating said switching elements;

wherein at least two of said elastic touch areas are arranged within said gripping region of said housing so that said elastic touch areas can be activated when gripping with one hand around said gripping region of said housing.

4. The power tool as defined in claim 3, wherein said power switching element is configured for galvanic separation of the load circuit coupled therewith from each signal circuit coupled therewith.

5. The power tool of claim 3, comprising at least one power switching element configured as an element selected from the group formed by a relay, a power semiconductor and an optocoupler.

6. The power tool of claim 3, comprising at least one switching element which is configured as a pushbutton.

7. The power tool of claim 6, comprising a plurality of switching elements being coupled to a circuit being configured for activating said motor when activating at least one of said switching elements.

8. The power tool of claim 6, comprising a plurality of switching elements being coupled to a circuit being configured for activating said motor when activating at least two of switching elements.

9. The power tool of claim 3, comprising at least one actuation member being coupled to a switching element for signaling a particular condition of said power tool depending on a particular state of said actuation member.

10. The power tool of claim 3, comprising at least one attachment part configured for attachment to or detachment from said housing, said at least one switching element being arranged on said housing for signaling whether said attachment part is attached to said housing or detached therefrom.

11. The power tool of claim 10, which is configured as a tool selected from the group formed by an angle sander and a hand-held disk saw, wherein said attachment part is configured as a protective cover and said switching element is coupled to said motor for allowing activation of said motor only when said protective cover is mounted correctly on said housing.

12. The power tool of claim 10, wherein said attachment part is configured as a handle which is coupled to a switching element for allowing an activation of said motor only when said handle is activated for activating said switching element.

13. The power tool of claim 9, further comprising a clamping lever for clamping the tool, said clamping lever being movable between a clamping position and a released position, a switching element being coupled to said clamping lever for indicating whether said clamping lever is in said clamping position or in said released position.

14. The power tool of claim 3, further comprising a molded body attached to said housing and comprising at least one support for mounting a switching element thereon.

15. The power tool 14, wherein said molded body is configured for supporting at least one electric line that can be connected with a switching element.

16. The power tool of claim 14, wherein said molded body cooperates with said housing for shielding elements supported thereon against contamination by dust, humidity or debris.

17. The power tool of claims 14, wherein said molded body is made of a material selected from the group formed by a vibration-damping and an acoustically damping material.

18. The power tool of claims 14, wherein said molded body comprises an electric shielding means for electrically shielding at least one electric line.

19. A power tool comprising:

a housing comprising a gripping region;

a motor received within said housing for driving a tool;

at least two switching elements configured as micro switches, said switching elements being connected in a signal circuit and being coupled to a load circuit via at least one power switching element;

said elastic touch areas being integrated within said gripping region of said housing and being accessible from outside the housing for activating said switching elements;

wherein at least two of said elastic touch areas are arranged within said gripping region of said housing so that both elastic touch areas can be activated simultaneously when gripping with one hand around said gripping region of said housing.

20. The power tool of claim 19, wherein said two elastic touch areas are arranged one opposite to the other on an outer part of said gripping region.

* * * * *